US006390954B1

(12) United States Patent
Lee

(10) Patent No.: US 6,390,954 B1
(45) Date of Patent: May 21, 2002

(54) STEP EXERCISER

(76) Inventor: Kuo-Lung Lee, No. 61, Mai Jou II Rd., Yi Lan City (TW)

( * ) Notice: Subject to any disclaimer, the term of this patent is extended or adjusted under 35 U.S.C. 154(b) by 0 days.

(21) Appl. No.: 09/867,452

(22) Filed: May 31, 2001

(51) Int. Cl.[7] ..... A63B 69/16
(52) U.S. Cl. ..... 482/52; 482/51; 482/57
(58) Field of Search ..... 482/51, 52, 53, 482/57, 70, 79, 80

(56) References Cited

U.S. PATENT DOCUMENTS 5,997,445 A * 12/1999 Maresh et al. ..... 482/70
6,171,217 B1 * 1/2001 Cutler ..... 482/57
6,238,321 B1 * 5/2001 Arnold et al. ..... 482/52
6,277,054 B1 * 8/2001 Kuo ..... 482/51

* cited by examiner

*Primary Examiner*—Stephen R. Crow
(74) *Attorney, Agent, or Firm*—Vardnell & Vardnell, PLLC

(57) ABSTRACT

A step exerciser includes two pedal rods coupled to two cranks at two sides of the wheel axle of a flywheel for enabling the flywheel to be rotated when the user steps the pedal rods alternatively up and down, and a coupling device is coupled a round rod at one end of each of the cranks and a U-lug at one end of each of the pedal rods, the coupling device having a vertical axle bearing block connected to the U-lug by a screw bolt and a locknut, and a horizontal axle bearing block fixedly connected to the horizontal axle bearing block at right angles and adapted to support the round rod of one of the cranks in the U-lug at one end of one of the pedal rods to reduce friction and noise during operation of the step exerciser.

4 Claims, 8 Drawing Sheets

STEP EXERCISER

BACKGROUND AND SUMMARY OF THE INVENTION

The present invention relates to an exercising machine and, more particularly, to a step exerciser, which uses a coupling device with a horizontal axle bearing block and a vertical axle bearing block to couple each pedal rod to the crank at each end of the wheel axle of a flywheel, so that less noise is produced during the operation of the step exerciser.

FIGS. 1 and 2 show a step exerciser constructed according to the prior art. According to this structure of step exerciser, two cranks 821 are respectively coupled between the ends of the wheel axle of a flywheel 82 and two pedal rods 81, and the pedal rods 81 each have an axle sleeve 812 coupled to a round rod 8211 at one crank 821 and a rear end provided with a roller 811, which is moved with the respective pedal rod 81 in a longitudinal sliding groove 831 of a respective rail 83. This structure of step exerciser has drawbacks. During the operation of the step exerciser, the pedal rods 81 tend to vibrate when moved back and forth along the longitudinal sliding groove 831 of the respective rail 83, resulting in high noise level. Further, a friction resistance is produced in the connection area between each crank 821 and the corresponding pedal rod 81, hindering the movement of the respective pedal rod 81. FIG. 3 illustrates another prior art design, in which the pedal rod 81 has a barrel 912 transversely disposed at its one end and coupled to the round rod 9211 of one crank 921, and a bushing 94 is sleeved onto the round rod 9211 and secured to the inside of the barrel 912 by holding down screws 95. When assembled, a gap 910 is left between the outside wall of the bushing 94 and the inside wall of the barrel 912 to accommodate relative movement between the pedal rod 91 and the crank 921. This design is still not satisfactory in function. Because the holding down screws 95 are directly stopped against the periphery of the bushing 94, the holding down screws 95. wear quickly with use and, much noise is produced during reciprocating motion of the pedal rod 91. Further, because the round rod 912 is coupled to the pedal rod 91 in horizontal direction, driving force is not efficiently transmitted from the pedal rod 91 to the crank 921, and the user must employ much effort to move the pedal rod 91 during the stroke where the crank 921 is moved to vertical position.

The present invention has been accomplished to provide a step exerciser, which eliminates the drawbacks of the aforesaid prior art designs. According to one aspect of the present invention, the step exerciser comprises two pedal rods coupled to two cranks at two sides of the wheel axle of a flywheel for enabling the flywheel to be rotated when the user steps the pedal rods alternatively up and down, and a coupling device is coupled a round rod at one end of each of the cranks and a U-lug at one end of each of the pedal rods, the coupling device having a vertical axle bearing block connected to the U-lug by a screw bolt and a locknut, and a horizontal axle bearing block fixedly connected to the horizontal axle bearing block at right angles and adapted to support the round rod of one of the cranks in the U-lug at one end of one of the pedal rods to reduce friction and noise during operation of the step exerciser. When assembled, a gap is left between the periphery of the horizontal axle bearing block of the coupling device and the inner surface of the U-lug to accommodate the reciprocating motion of the respective pedal rod in the longitudinal sliding groove of the respective rail. According to another aspect of the present invention, the cranks each have a first crank half and a second crank half connected at right angels for transmission of driving force efficiently.

DETAILED DESCRIPTION OF THE PREFERRED EMBODIMENT

Figure 1:
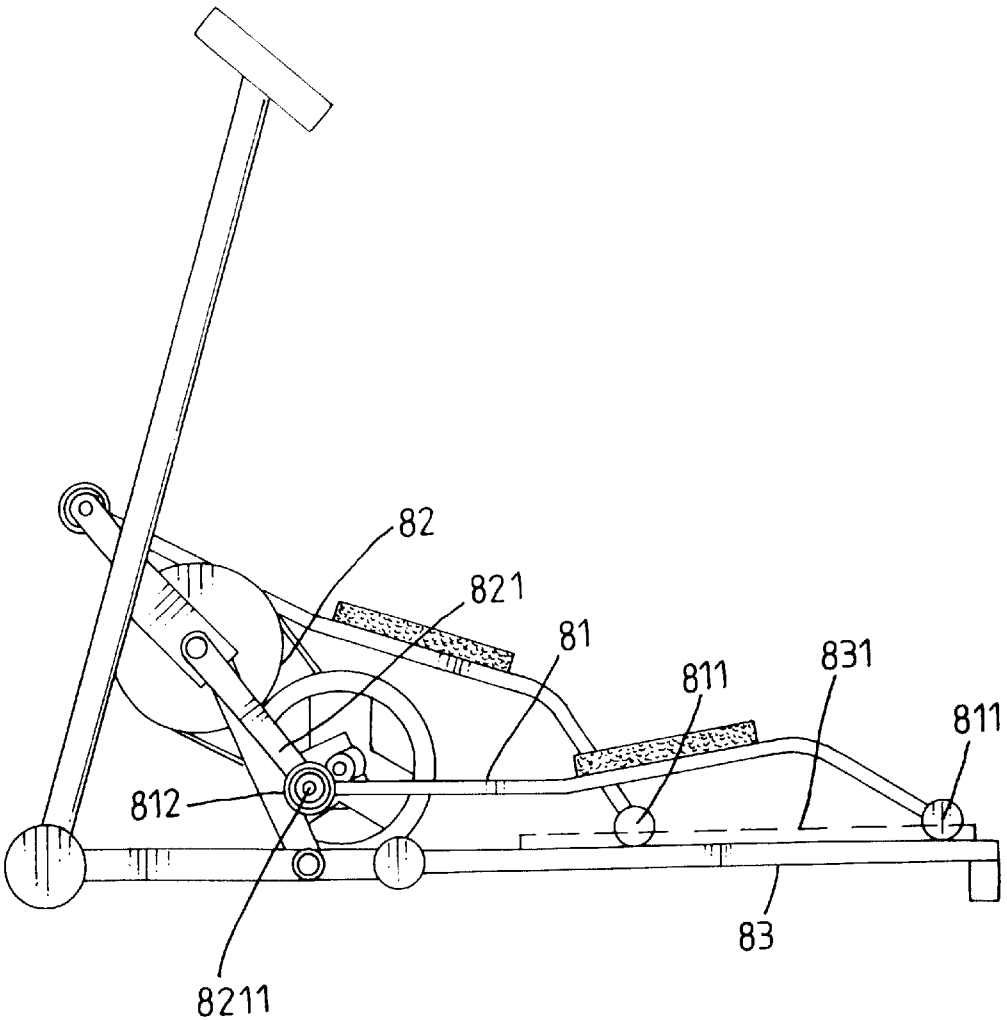
Fig. 1 PRIOR ART
FIG. 1 is a side plain view of a step exerciser constructed according to the prior art.
Figure 2:
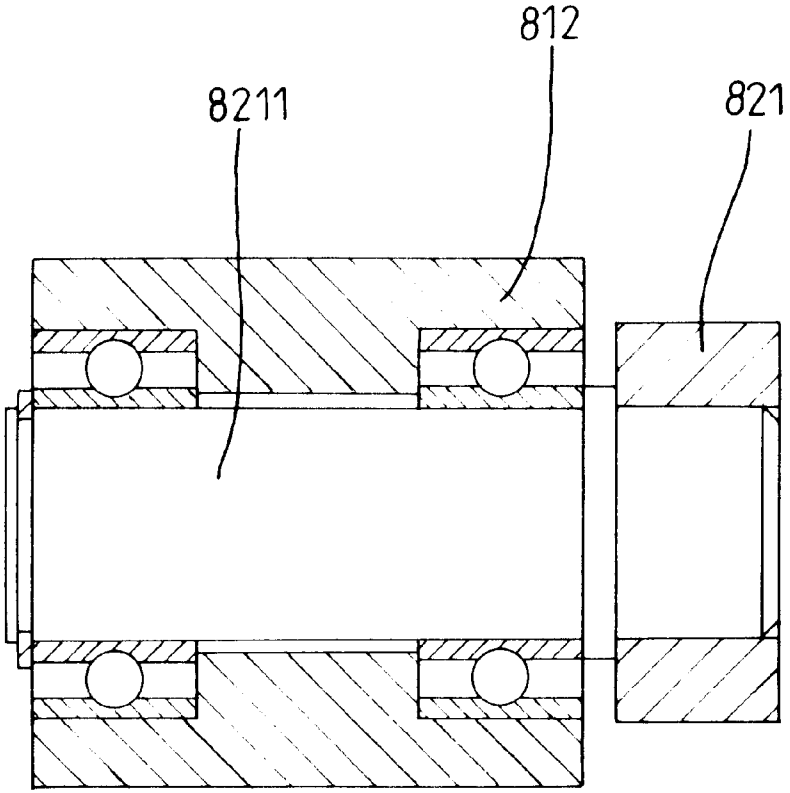
Fig. 2 PRIOR ART
FIG. 2 is a sectional view in an enlarged scale of a part of FIG. 1.
Figure 3:
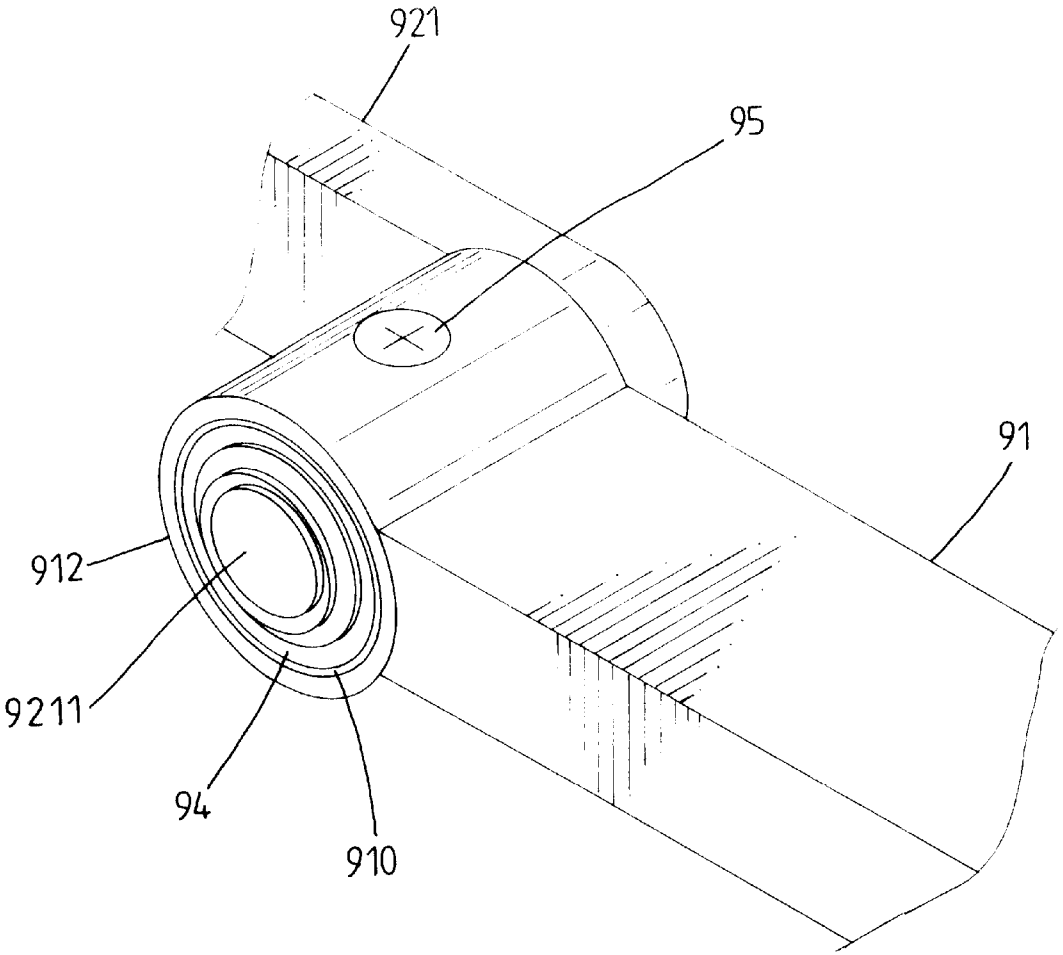
Fig. 3 PRIOR ART
FIG. 3 is an elevational view of a part of another structure of step exerciser according to the prior art.

Referring to FIGS. from 4 through 8, the step exerciser of the present invention comprises a base frame 1, the base frame 1 comprising two parallel rails 11, each rail 11 having a longitudinal sliding groove 111, a front upright 2 upwardly extended from the front side of the base frame 1, two handles 7 respectively pivoted to the front upright 2 at two sides, a flywheel 3 supported on the front upright 2 near the base frame 1 (see FIG. 4), a damping wheel 30 mounted on the base frame 1 and adapted to impart a damping resistance to the flywheel 3 (see FIG. 5), two cranks 32, the cranks 32 each having one end respectively coupled to two opposite ends of the wheel axle 31 of the flywheel 3 and the other end fixedly provided with an outwardly extended round rod 321, two pedal rods 4, the pedal rods 4 each having a front end respectively pivoted to the outwardly extended round rod 321 of each of the cranks 32 and a rear end provided with a respective roller 41, which is moved with the respective pedal rod 4 back and forth in the longitudinal sliding groove 111 of one rail 11 of the base frame 1, two footplates 40 respectively fixedly mounted on the pedal rods 4 on the middle at a top side, two links 5, the links 5 each having a rear end 51 pivoted to a side rod 43 at one side of one pedal rod 4 (see FIG. 5) and a front end 52 pivoted to the bottom end 71 of one handle 7, and a shell 20 mounted on the upright 2 to keep the flywheel 3 and the damping wheel 30 from sight. When stepping the pedal rods 4 alternatively with the legs, the flywheel 3 is rotated, the cranks 32 are moved along an oval path, the roller 41 of each pedal rod 4 is moved back and forth along the longitudinal sliding groove 111 of the corresponding rail 11, and the handles 7 are alternatively turned back and forth.

Figure 7:
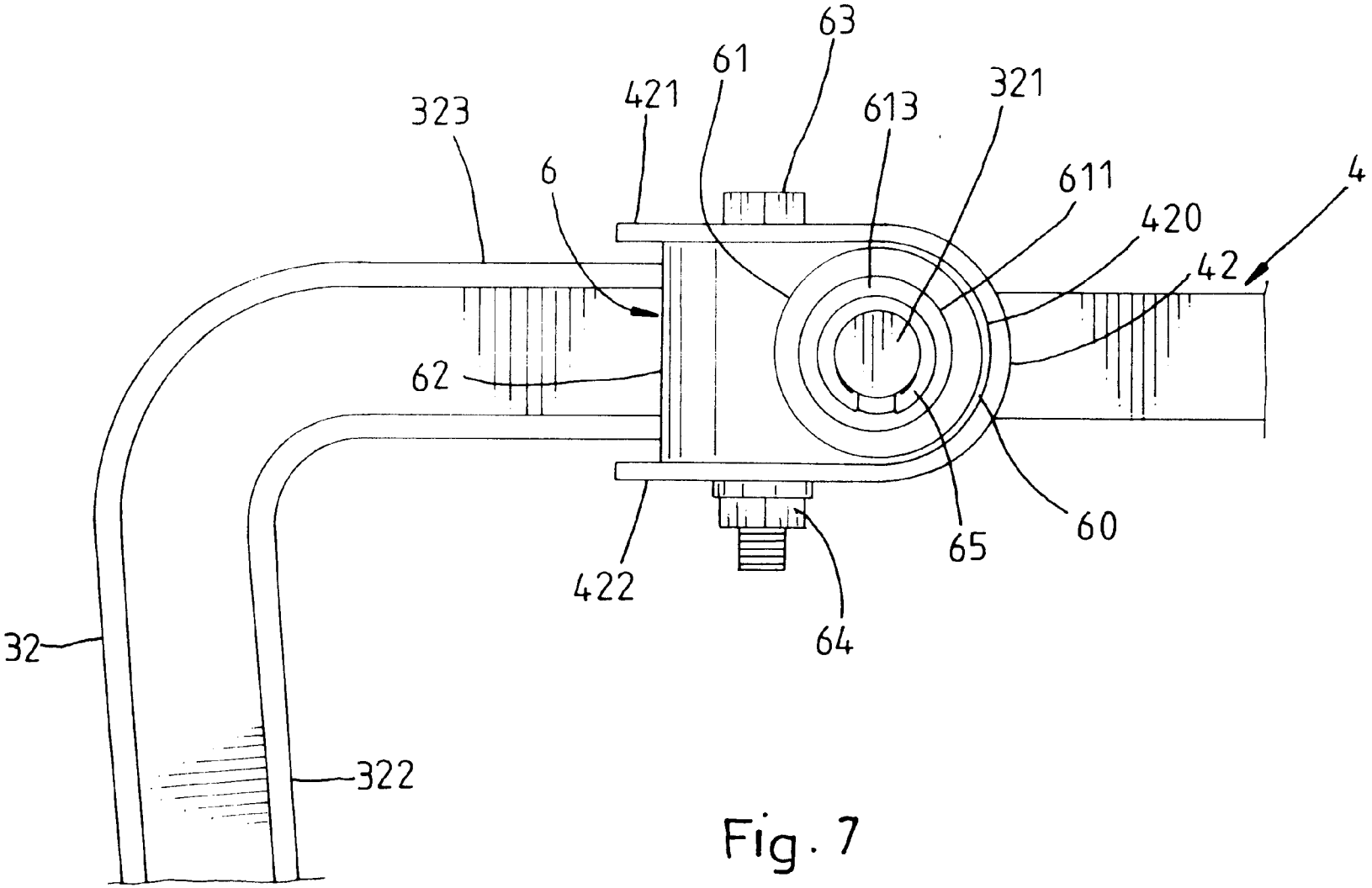
FIG. 7 is an assembly view in an enlarged scale of FIG. 6.

The main features of the present invention are outlined hereinafter. The cranks 32 each have a first crank half 322 coupled to one end of the wheel axle 31 of the flywheel 3 and a second crank half 323 extended from the first crank half 322 at an angle. The round rod 321 of each crank 32 is perpendicularly extended from an outer side of one end of the second crank half 322 of the respective crank 32. A coupling device 6 is coupled between the round rod 321 of one crank 32 and the front end of one pedal rod 4. The coupling device 6 comprises a horizontal axle bearing block 61 and a vertical axle bearing block 62 fixedly peripherally connected at right angles. The horizontal axle bearing block 61 comprises an axial through hole 611 and an axle bearing 613 mounted in the axial through hole 611. The vertical axle bearing block 62 comprises an axial through hole 621 and an axle bearing 620 mounted in the axial through hole 621. The front end of each pedal rod 4 is fixedly mounted with a U-lug 42. The U-lug 42 comprises a horizontal top wall portion 421, a horizontal bottom wall portion 422, a smoothly arched side wall portion 420 connected between the horizontal top wall portion 421 and the horizontal bottom wall portion 422 at one side and fastened to the front end of the respective pedal rod 4, a first pivot hole 4211 formed in the horizontal top wall portion 421, and a second pivot hole 4221 formed in the horizontal bottom wall portion 422. A screw bolt 63 is inserted through the first pivot hole 4211 and second pivot hole 4221 of the U-lug 42 and the axle bearing 620 of the vertical axle bearing block 62 of the coupling device 6 and screwed up with a lock nut 64 to secure the coupling device 6 to the U-lug 42, keeping the horizontal axle bearing block 61 suspended in the U-lug 42. The outwardly extended round rod 321 of each crank 32 is supported in the axle bearing 613 of the, horizontal axle bearing block 61 of the corresponding coupling device 6. After insertion of the outwardly extended round rod, 321 of each crank 32 through the axle bearing 613 of the horizontal axle bearing block 61 of the corresponding coupling device 6, a clamp 65 is fastened to the end of the outwardly extended round rod 321 to secure the respective crank 32 to the horizontal axle bearing block 61 of the respective coupling device 6. When assembled, a gap 60 is left between the periphery 610 of the horizontal axle bearing block 61 of each coupling device 6 and the inner surface of the smoothly arched sidewall portion 420 of the U-lug 42 of each pedal rod 4 (see FIG. 7). The gap 60 accommodates the reciprocating movement of the respective pedal rod 4 in the longitudinal sliding groove 111 of the respective rail 11, reducing the production of noises during reciprocating motion of the respective pedal rod 4. Because the head of the screw bolt 63 and the lock nut 64 are disposed in contact with the horizontal top wall portion 421 and horizontal bottom wall portion 422 of the corresponding U-lug 42 without touching the periphery 610 of the horizontal axle bearing block 61 of the corresponding coupling device 6, the relative movement between the crank 32 and the corresponding pedal rod 4 does not loosen the screw bolt 63 easily, and less noise is produced during the reciprocating motion of the respective pedal rod 4.

Further, the first crank half 322 and second crank half 323 of each crank 32 is preferably arranged at right angles, defining a 90° contained angle, so that applied force can be efficiently transmitted from the respective pedal rod 4 to the flywheel 3.

Figure 4:
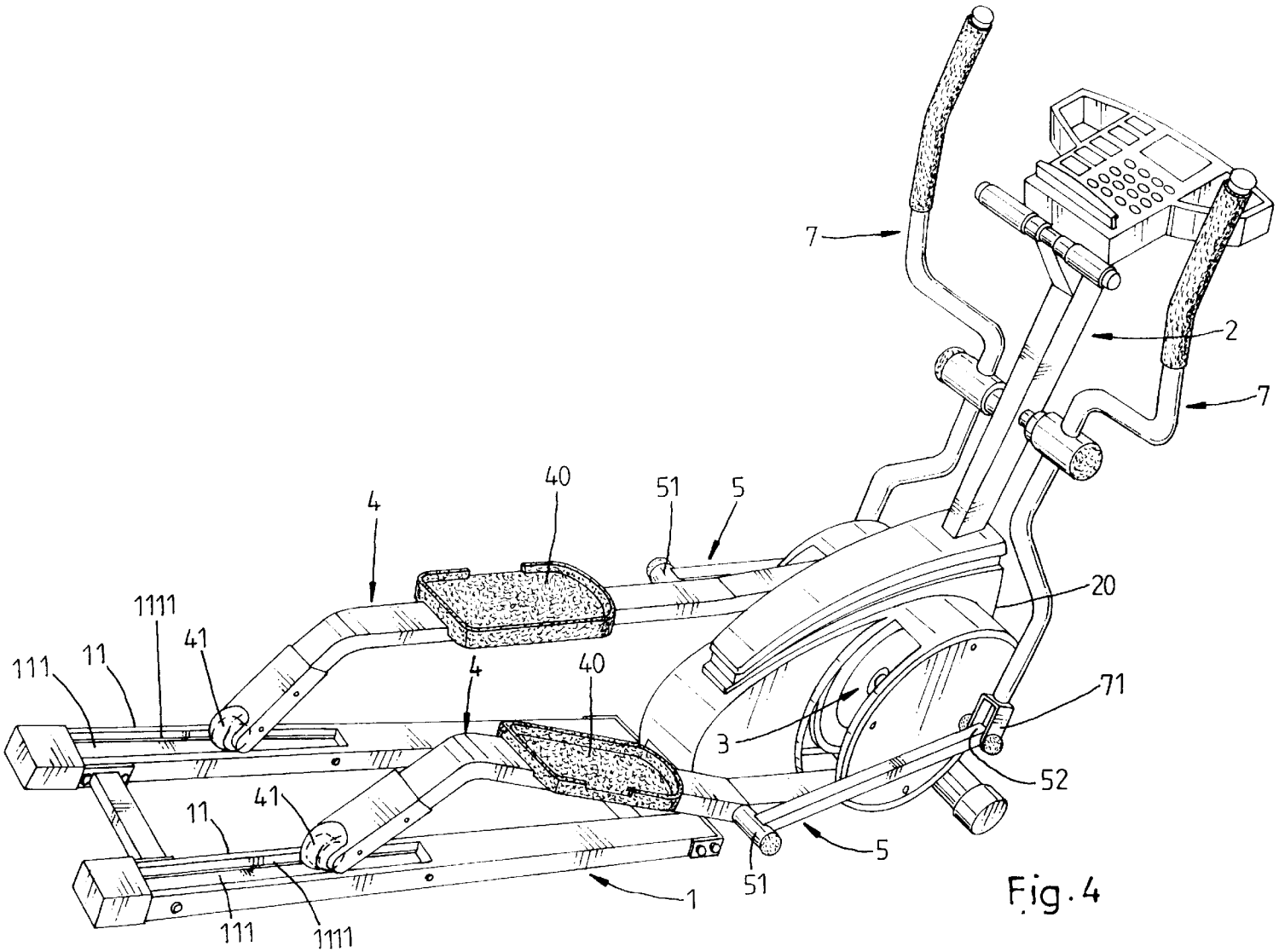
FIG. 4 is an elevational view of a step exerciser constructed according to the present invention.
Figure 5:
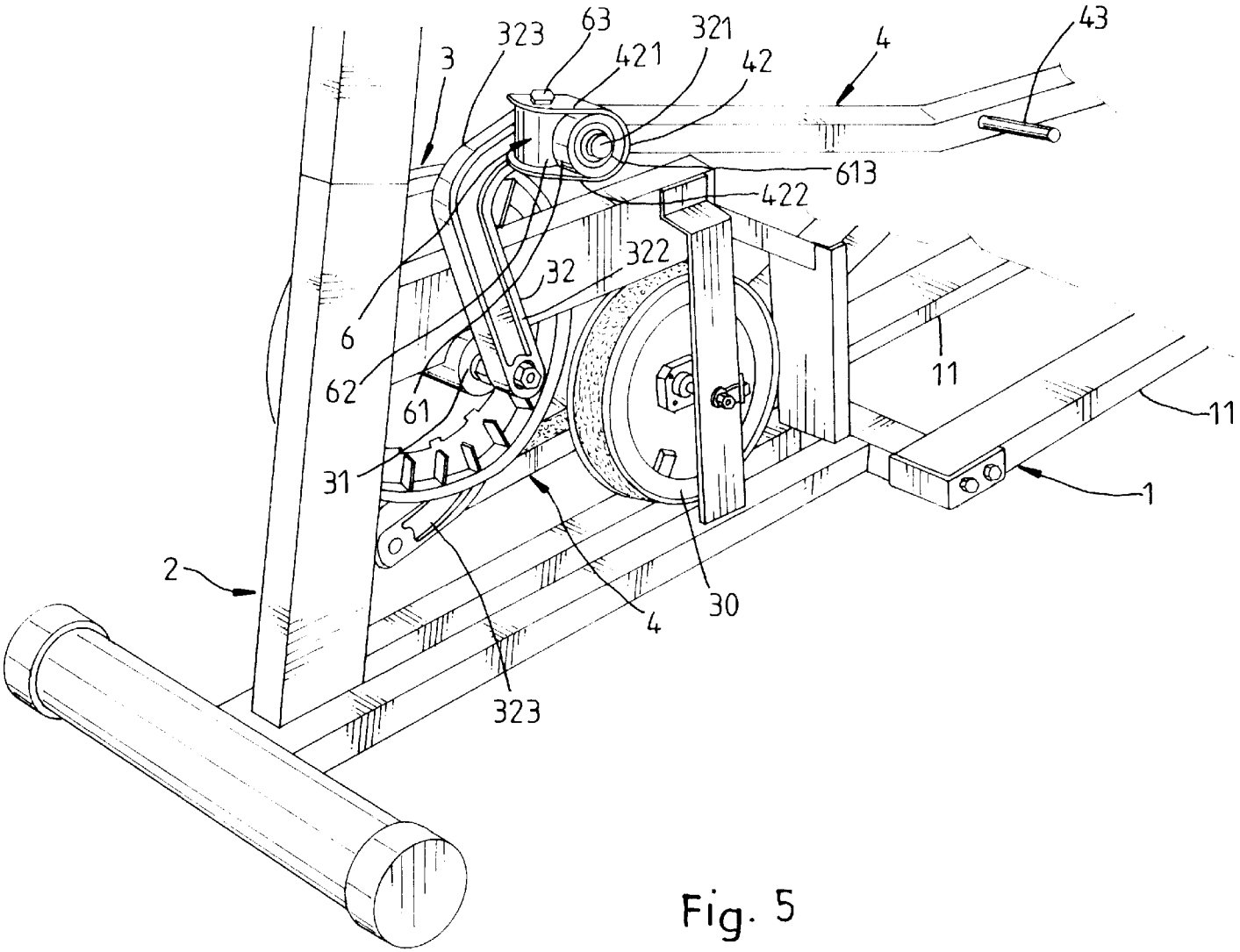
FIG. 5 is a perspective view of a part of the step exerciser according to the present invention.
Figure 6:
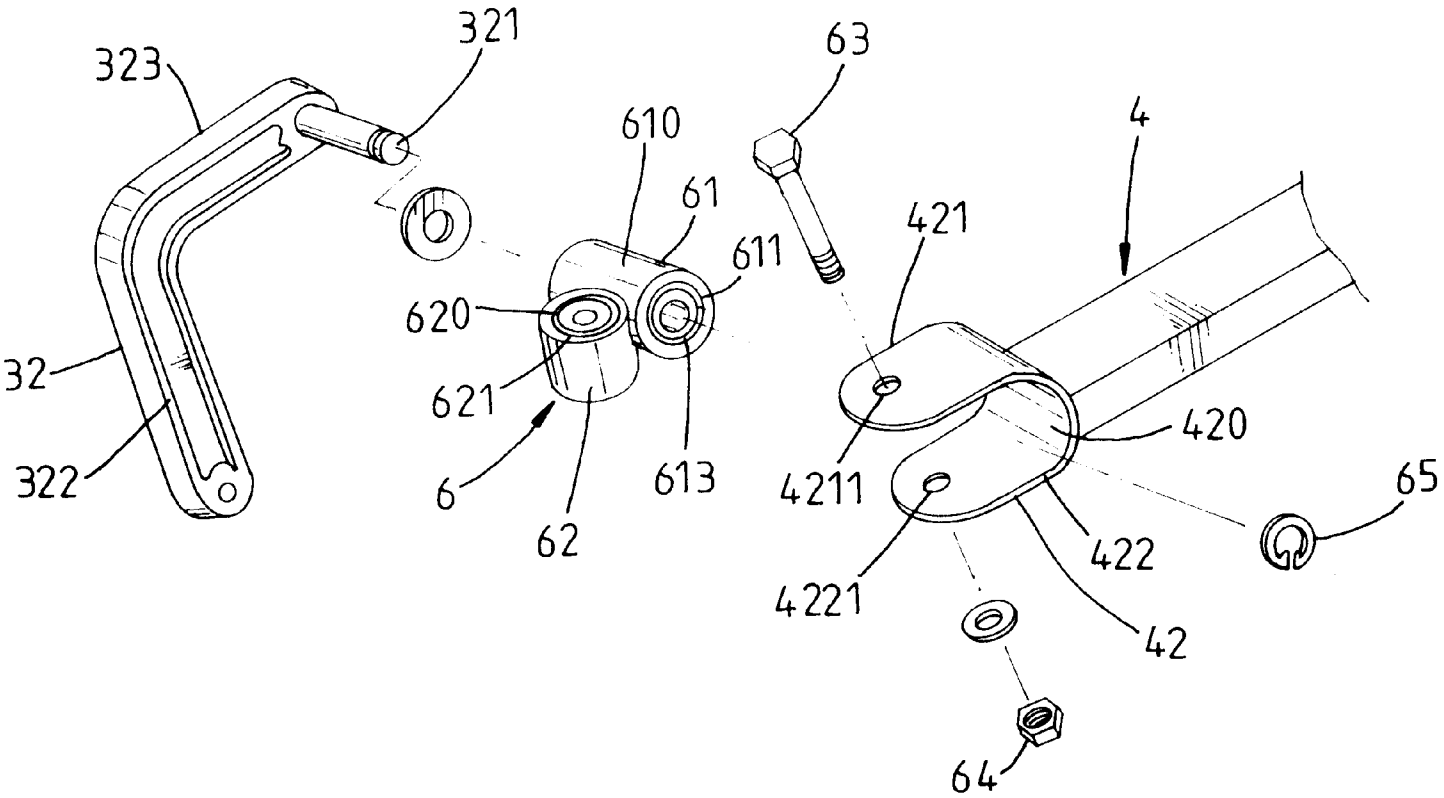
FIG. 6 is an exploded view of a part of the present invention.
Figure 8:
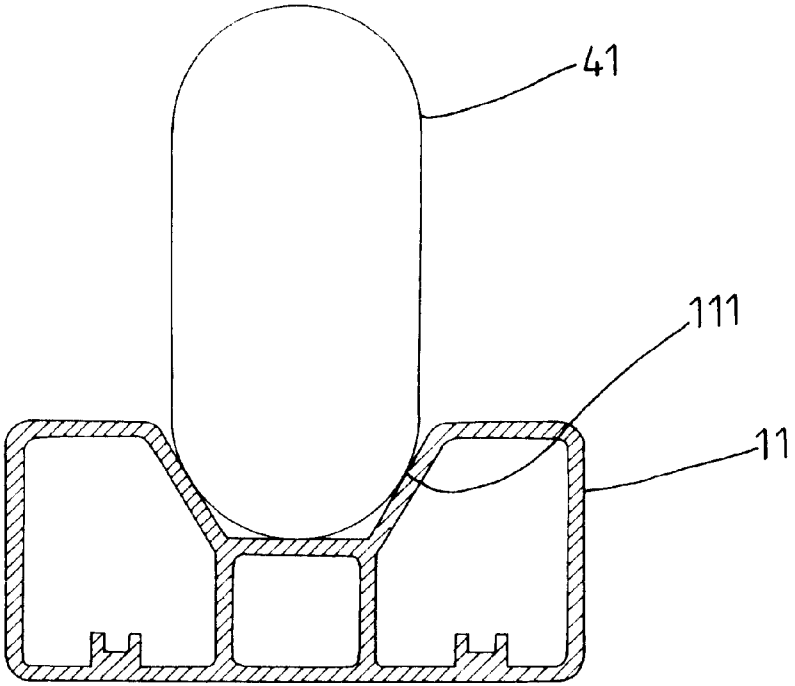
FIG. 8 is a sectional view in an enlarged scale of a part of the present invention, showing the structure of the longitudinal sliding groove of the rail.

Referring to FIGS. 4 and 8, the longitudinal sliding groove 111 of each rail 11 of the base frame 1 has two sloping sidewalls 1111 adapted to guide movement of the roller 41 of the corresponding pedal rod 4 in the longitudinal sliding groove 111 smoothly. Because the roller 41 of the pedal rod 4 is maintained in contact with the longitudinal sliding groove 111 of the corresponding rail 11 at three contact points (one at the bottom sidewall, of the corresponding longitudinal sliding groove, and the other two at the sloping sidewalls of the corresponding longitudinal sliding groove), less friction resistance and noise are produced during the reciprocating motion of the corresponding pedal rod 4.

A prototype of step exerciser has been constructed with the features of FIGS. 4–8. The step exerciser functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A step exerciser comprising: a base frame, said base frame comprising two parallel rails, said rails each having a longitudinal sliding groove, a front upright upwardly extended from a front side of said base frame, two handles respectively pivoted to said front upright at two sides, a flywheel supported on said front upright near said, base frame, said flywheel having a center wheel axle, a damping wheel mounted on said base frame and adapted to impart a damping resistance to said flywheel, two cranks, said cranks each having one end respectively coupled to two opposite ends of said wheel axle of said flywheel and an opposite end fixedly provided with an outwardly extended round rod, two pedal rods, said pedal rods each having a front end respectively pivoted to the outwardly extended round rod of each of said cranks and a rear end provided with a respective roller, which is moved with the respective pedal rod back and forth in the longitudinal sliding groove of one of said rails of said base frame, two footplates respectively fixedly mounted on said pedal rods on the middle at a top side, two links, said links each having a rear end respectively pivoted to said pedal rods and a front end respectively pivoted to a bottom end of each of said handles, and a shell mounted on said upright to keep said flywheel and said damping wheel from sight;

Wherein:

a coupling structure is respectively coupled between the round rod of each of said cranks and the front end of each of said pedal rods, said coupling structure comprising a U-lug fixedly fastened to the front end of one of said pedal rods, a coupling device coupled to the round rod of one of said cranks, and a screw bolt and a locknut fastened together to secure said coupling device to said U-lug, said U-lug comprising a horizontal top wall portion, a horizontal bottom wall portion, a smoothly arched side wall portion connected between said horizontal top wall portion and said horizontal bottom wall portion at one side and fixedly fastened to the front end of one of said pedal rods, a first pivot hole 1 formed in said horizontal top wall portion, and a second pivot hole formed in said horizontal bottom wall portion, said coupling device comprising a horizontal axle bearing block coupled to the round rod of one of said cranks, and a vertical axle bearing block fixedly peripherally connected to said horizontal axle bearing block at right angles and secured to said U-lug between the horizontal top wall portion and horizontal bottom wall portion of said U-lug by said screw bolt and said locknut, said screw bolt being inserted through said first pivot hole and said second pivot hole of said U-lug and supported in said vertical axle bearing block of said coupling device, said locknut being fastened to said screw bolt to secure said screw bolt to said U-lug and said vertical axle bearing block of said coupling device, said horizontal axle bearing block of said coupling block being received in said U-lug to support the round of one of said cranks in said U-lug and defining with an inner surface of said smoothly arched side wall of said U-lug a gap.

2. The step exerciser of claim 1 wherein said cranks each comprise a first crank half pivoted to one end of the wheel axle of said flywheel, and a second crank half extended from one end of said first crank half at right angles, and the round of each of said cranks is perpendicularly extended from one end of the second crank half of the respective crank at one side.

3. The step exerciser of claim 1 wherein said coupling structure further comprises a C-shaped retainer fastened to the round rod of one of said cranks to secure the corresponding crank to the horizontal axle; bearing block of said coupling device.

4. The step exerciser of claim 1 wherein the longitudinal sliding groove of each of said rails of said base frame has two sloping sidewalls adapted to guide movement of the roller of one of said pedal rods.

* * * * *